US006122807A

United States Patent [19]

Beltramini

[11] Patent Number: 6,122,807

[45] Date of Patent: Sep. 26, 2000

[54] MECHANICAL PROCESS, WET OR DRY, TO OBTAIN CONTINUOUS CHANGES IN APPEARANCE AND COLOR OF TEXTILE FABRICS USING ROLLERS COATED WITH DIAMOND POWDER

[75] Inventor: Giorgio Beltramini, Paderno Dugnano, Italy

[73] Assignee: North Bel International S.R.L., Paderno Dugnano, Italy

[21] Appl. No.: 09/011,282

[22] PCT Filed: Dec. 29, 1995

[86] PCT No.: PCT/IT95/00228

§ 371 Date: Feb. 9, 1998

§ 102(e) Date: Feb. 9, 1998

[87] PCT Pub. No.: WO97/14841

PCT Pub. Date: Apr. 24, 1997

[30] Foreign Application Priority Data

Oct. 20, 1995 [IT] Italy ..... MI95A2182

[51] Int. Cl.[7] ..... D06C 11/00

[52] U.S. Cl. ..... 26/28

[58] Field of Search ..... 26/27, 28, 105, 26/69 R, 69 C; 28/163, 165, 167; 68/175, 158, 147; 8/151; 492/28, 30, 35, 44

[56] References Cited

U.S. PATENT DOCUMENTS

| | | | |
|---|---|---|---|
| 2,035,640 | 3/1936 | Dickie et al. | 26/27 |
| 3,553,801 | 1/1971 | Hadley | 26/28 |
| 3,894,318 | 7/1975 | Ito et al. | 26/28 |
| 4,263,790 | 4/1981 | Stopp et al. | 26/14 |
| 4,607,409 | 8/1986 | Hishimuma et al. | 26/28 |
| 5,362,499 | 11/1994 | Bertoldo | 26/28 |
| 5,492,037 | 2/1996 | Graham | 26/83 |
| 5,636,534 | 6/1997 | Bertoldo | 26/28 |

FOREIGN PATENT DOCUMENTS

| | | | |
|---|---|---|---|
| 620307 | 10/1994 | European Pat. Off. | 26/28 |
| 665318 | 8/1995 | European Pat. Off. | 26/28 |
| 574559 | 7/1924 | France | 26/28 |

*Primary Examiner*—Amy B. Vanatta
*Attorney, Agent, or Firm*—Michael J. Striker

[57] ABSTRACT

Mechanical process, rollers and machines (10) for obtaining continuous modification of the appearance and color of textile fabrics by passage, dry or wet, of the fabric (41) under tension, around rollers (23–26) with a coating (35) of diamond powder, uniformly or in areas marked out in their surfaces.

12 Claims, 5 Drawing Sheets fig. 7
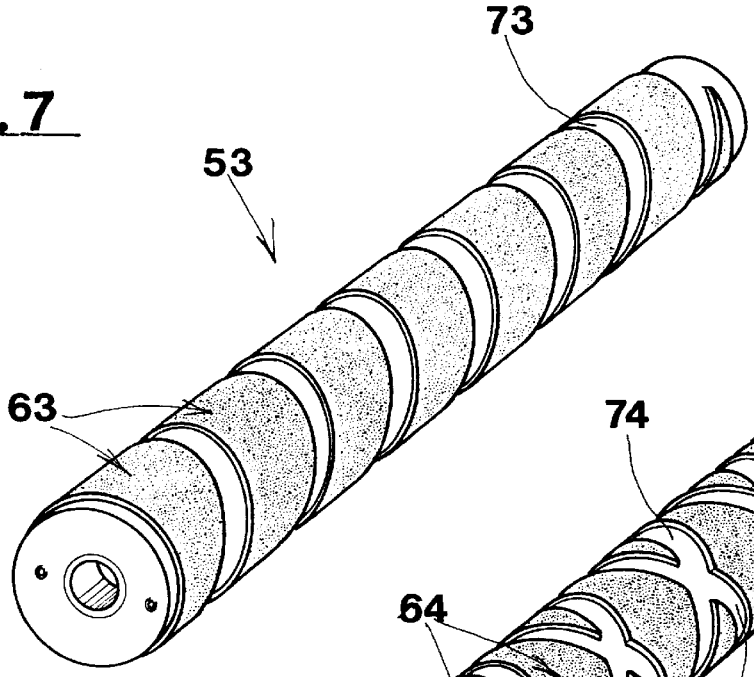
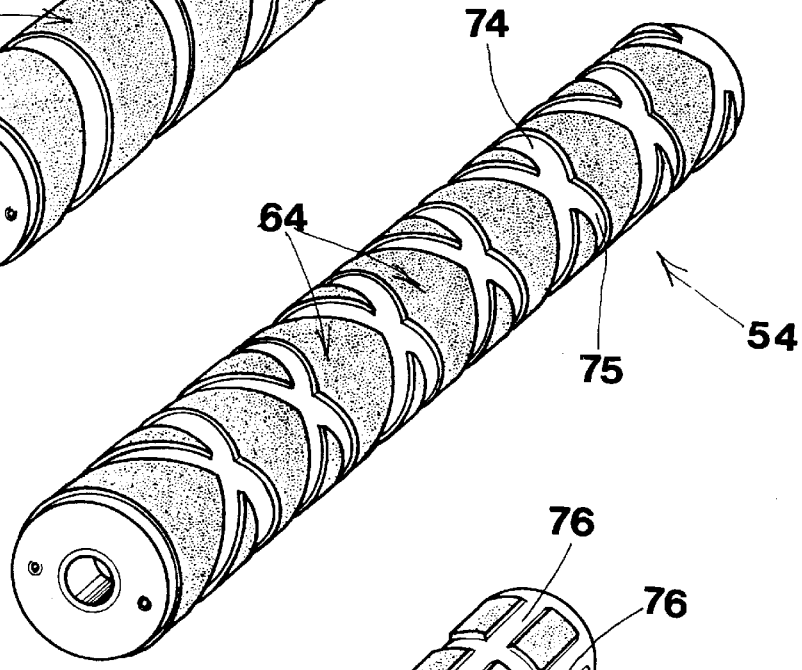
fig. 8
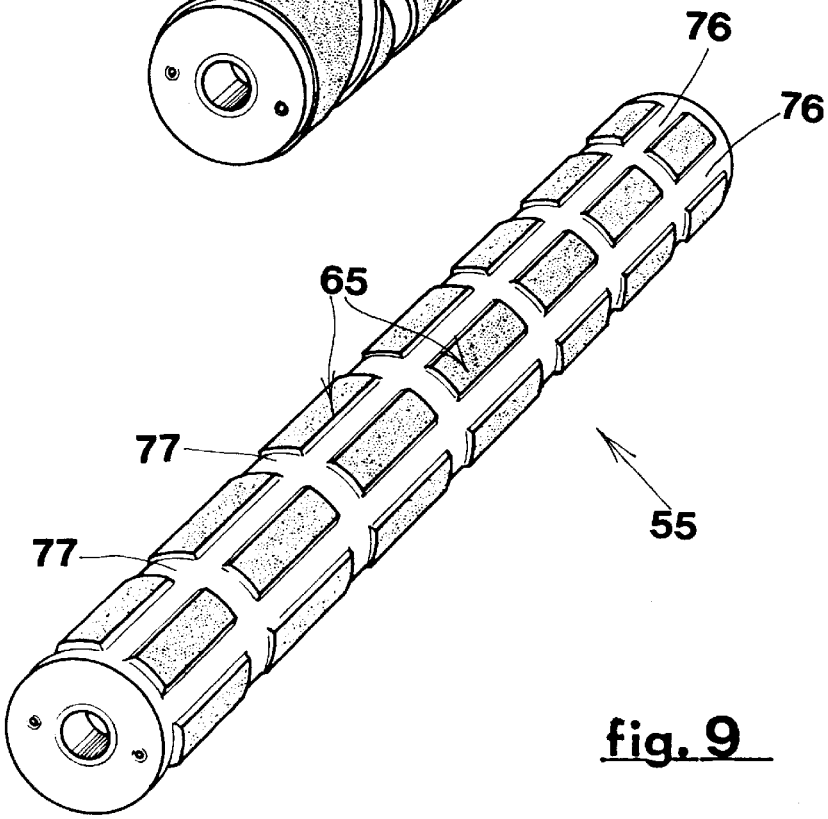
fig. 9

Figure 1:
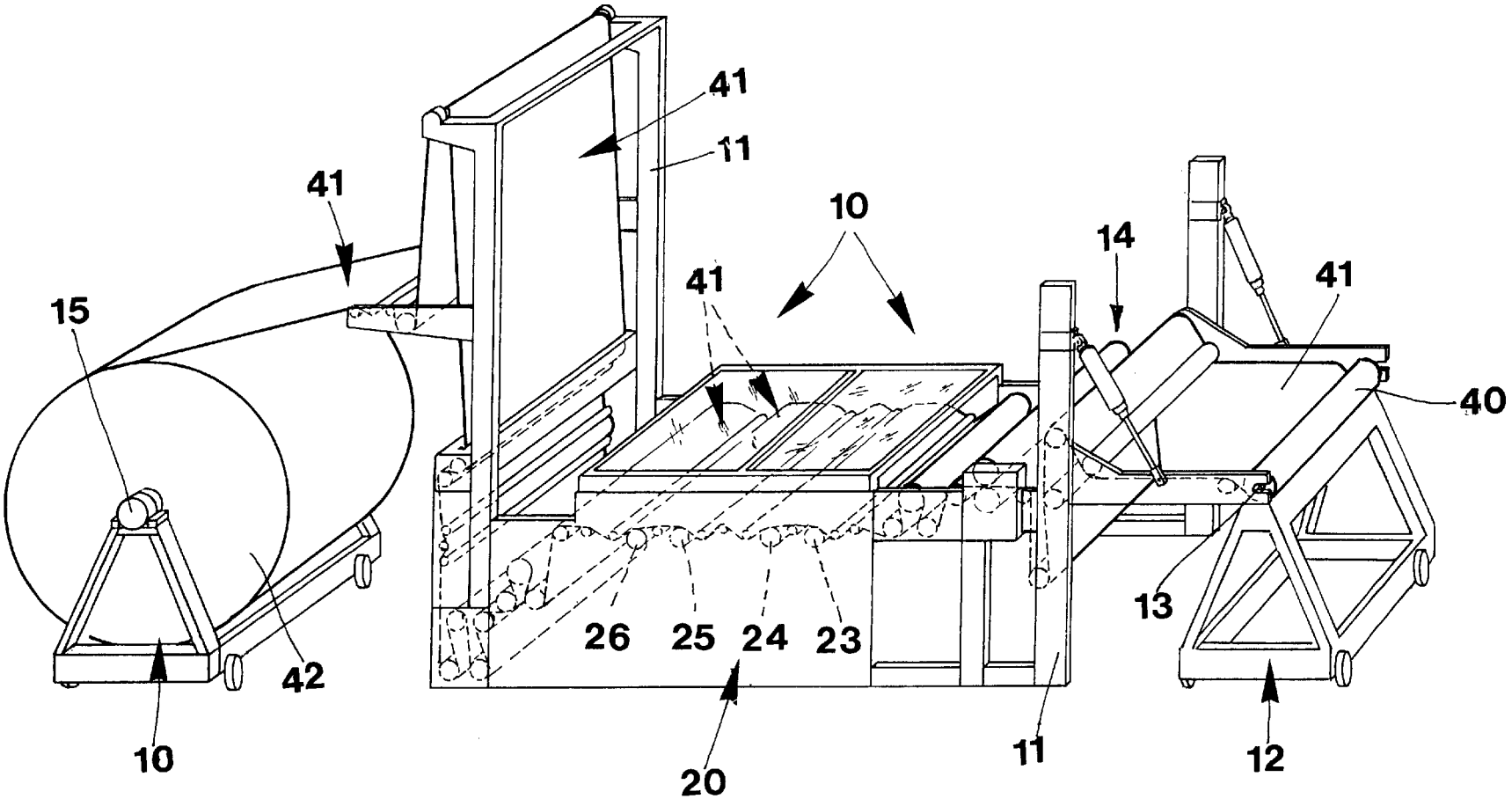

MECHANICAL PROCESS, WET OR DRY, TO OBTAIN CONTINUOUS CHANGES IN APPEARANCE AND COLOR OF TEXTILE FABRICS USING ROLLERS COATED WITH DIAMOND POWDER

The invention concerns the processes, machines and equipment for changing the appearance and colour of textile fabrics to secure effects some of which may be special.

Machines and processes for altering the appearance and colour of fabrics generally are well known in the trade.

These changes may be brought about by chemical or mechanical methods.

If the process is mechanical the machines used are those for lapping or finishing; they comprise lapping rollers, generally working dry, around which a fabric, stretched under tension, is passed by unwinding it from one roller and winding it, after lapping, onto another.

The lapping rollers have an abrasive coating, the type of grain used being decided by the desired result.

The coating consists of abrasive granules fixed onto a suitable support.

If the process is chemical the methods used are limited in the effects they produce and may damage the fabrics. Mechanical methods using rollers coated with abrasive granules raise many problems because of low efficiency, of the need for frequently redressing the abrasive layer, of the unevenness of results and because of obtaining effects which often are not those required.

Purpose of the invention is to provide a process for wet and dry lapping or finishing which offers considerable advantages compared with present processes both because of the effects obtained on all types of textile fabrics and because of its high production efficiency as will be explained below.

Subject of the invention is a process for continuous modification of surface appearance and colours on fabrics generally, in which process the fabric passes, stretched under tension, round a set of lapping rollers, the working surfaces of which carry a coating of diamond powder.

The diamond powder is applied to the surface of the roller by electrodeposition.

Shapes and sizes of the granules forming the diamond powder are chosen according to the desired abrasive action.

The fabric can be treated dry or wetted. For wet treatment, before its passage round the abrasive rollers, the fabric passes through a bath of liquid. The liquid may be water or may contain substances which, combined with the abrasive action, produce special effects on the treated fabric.

The working surface of the rollers may be divided up into areas of different shapes and sizes with intervals between one such area and another making the abrasive action more powerful due to the edges, which may be sharp,of the areas raised in relation to the spaces,facilitating discharge of particles removed and easier distribution of the liquid if the fabric is being treated wet.

The spaces may be strips with no diamond powder or even grooves in the surface of the rollers, with or without diamond powder, according to circumstances and preferences.

Also as circumstances require, the strips or grooves may be longitudinal or annular, placed at the same or different centre distances, the purpose of this being to produce on the fabric treated areas separated from untreated areas. The strips or grooves may be one or more halical pairs.

These pairs may lie in opposite directions and cross over. This produces excellent discharge flows of detached particles or dispersion of liquid if the treatment is wet. The strips or grooves may be partly longitudinal and partly annular, freely crossing one over another. Some rollers are motor-driven.

The number of rollers coated with diamond powder around which the fabric passes, and similarly the speed of one or other of the rollers,may be varied at will according to the effects it is desited to obtain.

The direction of rotation can be reversed for some or all rollers according to previously set stages of work. Clearance angle between fabric and rollers may be varied in accordance with the results to be produced.

Fabric tension can be varied as preferred to obtain that which is most suitable for the purpose.

The speed at which the fabric moves can also be varied. Action of the diamond coated rollers can be simultaneous on both sides of the fabric.

All working parameters chosen can be memorized in an electronic programmer so that they can be repeated.

The foregoing clearly shows that the present invention gives rise both to a new process, to new rollers and to new machines which, with the new rollers, make possible a new process.

The invention offers evident advantages.

The use of rollers coated with diamond powder permits an excellent treatment to be given with maximum output efficiency, maximum variety of action on all types of textile fabrics, and offers the possibility of repeating as desired the effects that have been programmed.

Processing can be not only dry but also wet causing no furring, and can be carried out on dyed and printed fabrics, on denim types and all done without chemicals. Any type of fabric can be treated, thin or thick, of natural or synthetic fibres, cotton, wool, viscous, linen, polyester, polyammide, cupro/rayon, nylon, imitation leather and every other type used.

Processing can be carried out simultaneously on both sides of the fabric.

Maximum consistency of effects over time is assured, as coaxiality of granules ensured by diamonds over the whole length of the lapping rollers, remains unaltered until completely worn down, within three/four hundredths at least.

Overall efficiency of the machine whose rollers have a diamond granule coating, is several times greater compared with present methods using common types of abrasives. There is no need for the redressing generally required. The possibility of using the best number of lapping rollers to suit the work required, gives a very high output and greater effects made possible by the fact that the rollers can also move in the transversal direction.

To sum up these advantages the strong and steady abrasive power of diamond powder realizes dry or wet lapping able to produce any effect desired on any textile fabric at a rate of output decided at will according to quantities required. This applies not only to a uniform all-over treatment of the fabric but also to the unlimited possibilities of patterns between treated areas, untreated areas and others treated differently, all due to what can be achieved with diamond powder coated rollers in which there is a variety of strips and grooves.

Characteristics and purposes of the invention will become still clearer on seeing the following examples of its execution illustrated by diagrammatically drawn figures.

FIG. 1 Machine, seen in perspective, for dry or wet lapping with lapping rollers, subject of the invention.

Figure 2:
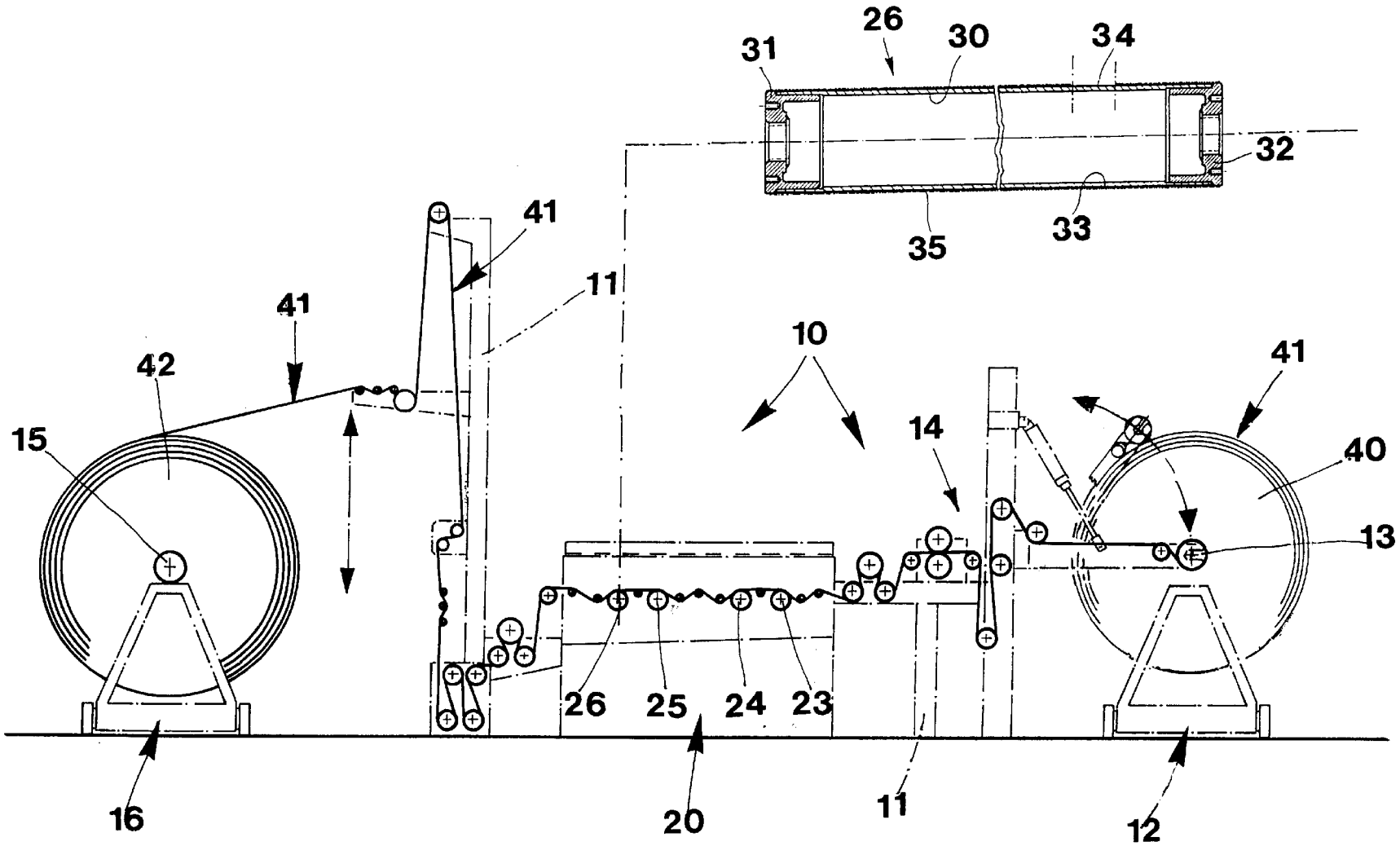

FIG. 2 Lateral diagrammatic view of the lapping machine.

Figure 3:
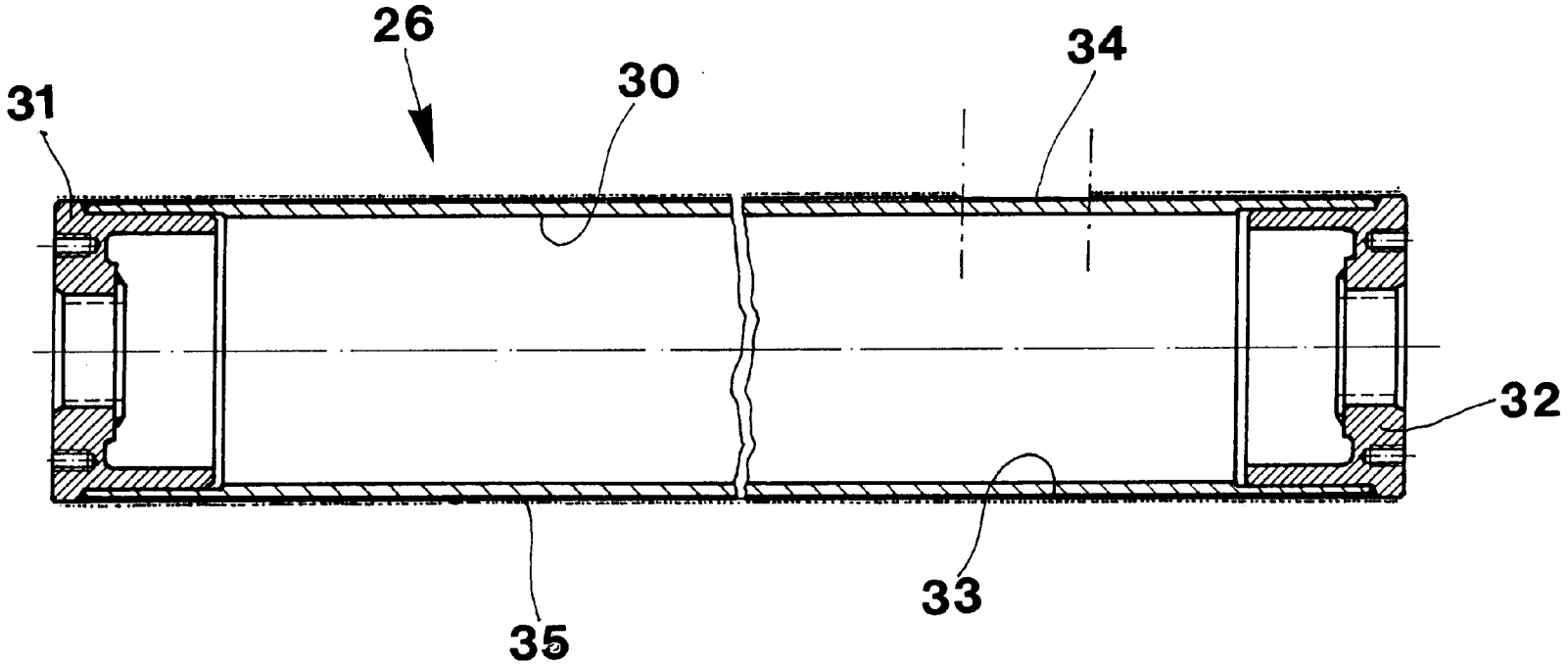

FIG. 3 Lateral cross section showing a detail of the structure of a lapping roller,according to the invention, whose surface is entirely coated with diamond powder.

Figure 4:
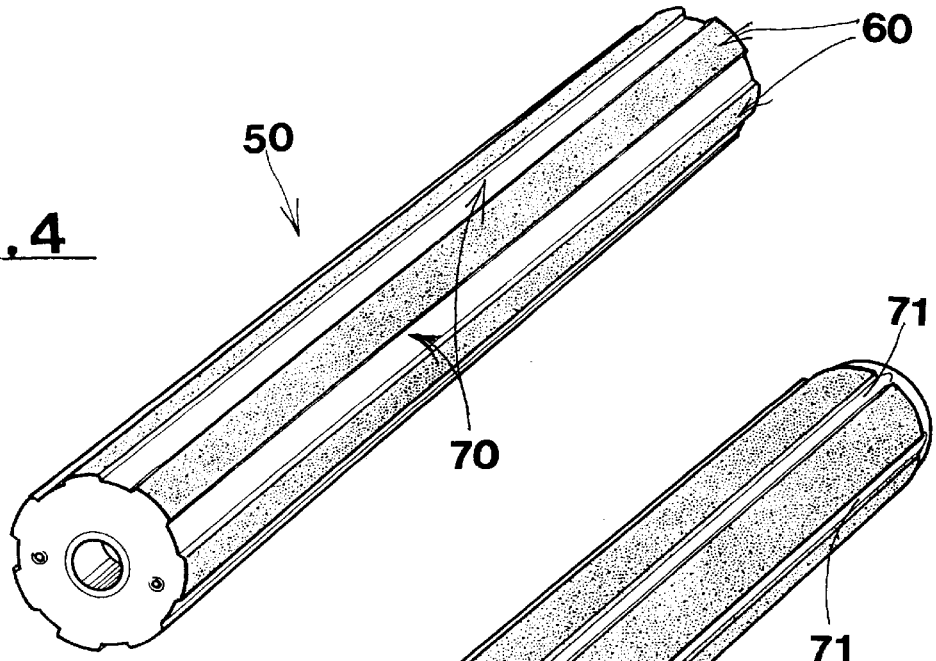

FIG. 4 Perspective view showing a detail of a roller whose working surface is divided by smooth longitudinal strips.

Figure 5:
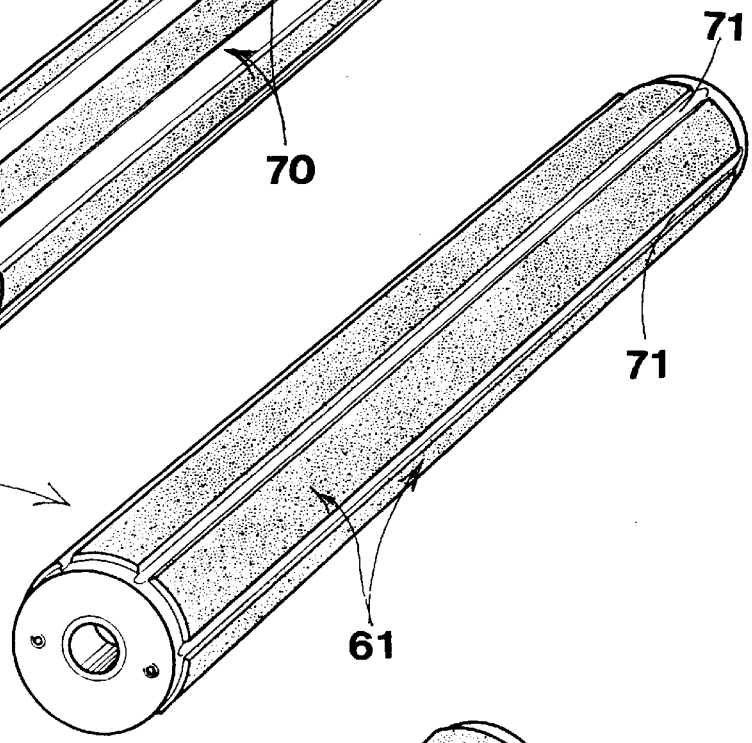

FIG. 5 Perspective view showing a detail of a roller whose working surface is divided by smooth longitudinal grooves.

Figure 6:
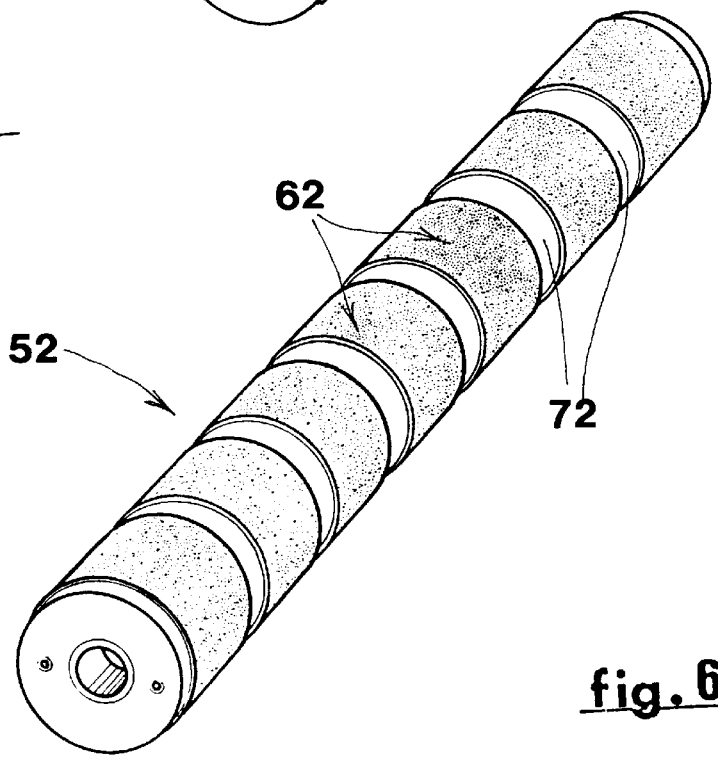

FIG. 6 Perspective view showing a detail of a roller whose working surface is divided by smooth annular strips.

FIG. 7 Perspective view showing a detail of a roller whose working surface is divided by helical grooves.

FIG. 8 Perspective view showing a detail of a roller whose working surface is overrun by a pair of helical grooves in opposite directions that cross each other.

FIG. 9 Detail of a roller in whose working surface are smooth longitudinal and annular strips that cross over.

The lapping machine 10 for textile fabrics comprises the base 11 with initial support 12 to sustain the rotating roller 13 on which is wound the roll 40 of fabric 41 to be treated.

Having passed a set of transmission units 14 and a bath of liquid, the stretched fabric passes through the set 20 of four lapping rollers 23–26 after which, treated and wrung out, it winds onto the roller 15 on the support 16 where it forms the roll 42 of treated fabric.

The lapping rollers like 26 in FIG. 3 comprise a metal tube 30 supported at its ends by drums 31 and 32. On the outside of the tube a laminated sheet 33 is laid, with its surface 34.

A layer 35 of diamond granules and powder is applied by electrodeposition to said laminated sheet.

These diamond granules carry out the function of thousands of single tools; they ensure high precision, strong abrasive power and long life.

Abrasive action obviously depends on granule size.

The fabric can be kept wet after passing through the humidifying bath and is kept constantly pulled.

The roller 50 in FIG. 4 has a working surface coated with diamond powder 60 divided up by smooth strips 42.

In FIG. 5 the working surface 61 of the roller 51 is divided up by longitudinal grooves 71.

The working surface 62 of the roller 52 in FIG. 6 is divided up by a series of smooth annular strips 72.

The working surface 63 of the roller 53 in FIG. 7 is divided up by a smooth helical strip 73.

In FIG. 8 the working surface of the roller 50 is divided up by a pair of smooth helical grooves 74 and 75 lying in opposite directions, one crossing the other.

FIG. 9 shows roller 55 whose working surface 65 is divided up by a set of longitudinal 76 and annular 77 strips. In all the types described in FIGS. 4–9, the smooth non-diamond coated strips can be replaced by grooves, or vice versa.

The centre distance between strips or grooves can be constant or varied as preferred, on any one roller or on one roller and another.

On any one roller there may be strips without diamond powder coating and grooves.

The diamond coated surface may include areas with granules of different sizes and possessing different characteristics.

The purpose of everything explained above is to produce particular effects on the appearance and colour of the fabric, as circumstances and preferences may require.

Lapping stages may be one or more, each with four, six or eight lapping rollers.

Movement of these rollers may also be transversal. The number of roller turns, their direction of rotation, clearance angle between fabric and lapping roller, tension of the fabric and speed of movement can all be regulated.

The fabric can be treated on both sides simultaneously.

All operating parameters are connected to a microprocessor so that they can be repeated as needed.

Speed of regulation can be adjusted over a wide range, for example from 10 to 30 m/min.

I claim:

1. A process for continuous modification of appearance of fabrics, comprising the steps of passing a fabric under tension around at least one of rollers of a lapping unit of a machine, with a working surface of said at least one roller formed of a coating of powdered diamonds; and simultaneously treating the fabric in both directions from one end of said at least one roller to the other and vice versa by providing on the working surface of said at least one roller a number of continuous helical grooves laid in opposite directions that cross over each other, so that simultaneously a discharge of abrasive particles is facilitated.

2. A process for continuous modification of appearance of fabrics as defined in claim 1, wherein said passing includes passing the fabric which is wet, so that the helical grooves also improve distribution of liquid over the fabric.

3. A process for continuous modification of appearance of fabrics as defined in claim 1; and further comprising the step of carrying out action by the lapping rollers simultaneously on both sides of the fabric.

4. A process for continuous modification of appearance of fabrics as defined in claim 1; and further comprising the steps of providing a wet treatment of the fabric; and using in the wet treatment a liquid product which has substances suitable for producing special effects on the treated fabric in synergy with an abrasive action of the powdered diamonds coating.

5. A process for continuous modification of appearance of fabrics as defined in claim 1; and further comprising the step of varying a speed of the rollers and a direction of rotation of the rollers for obtaining desired effects.

6. A process for continuous modification of appearance of fabrics as defined in claim 1; and further comprising the step of varying an angle of clearance between the fabric and the rollers for obtaining desired effects.

7. A process for continuous modification of appearance of fabrics as defined in claim 1; and further comprising the step of varying pulling on the fabric for obtaining desired effects.

8. A process for continuous modification of appearance of fabrics as defined in claim 1; and further comprising the step of varying a speed of movement of the fabric for obtaining desired effects.

9. A process for continuous modification of appearance of fabrics as defined in claim 1; and further comprising the steps of memorizing parameters chosen for processing of the fabric in an electronic programming device; and repeating the chosen parameters.

10. A machine for continuous modification of appearance of fabrics, comprising at least one section provided with a plurality of lapping rollers, at least one of said lapping rollers having a working surface formed of a coating of powdered diamonds, so that a fabric passes under tension around said at least one roller, said working surface of said at least one roller having a number of continuous helical grooves laid in opposite directions that cross each other, so that the fabric is simultaneously treated in both directions from one end of said at least one roller to the other and vice versa, and a discharge of abrasive particles is facilitated.

11. A machine as defined in claim 10, wherein a wet process is used, and said continuous helical grooves are formed so that a distribution of a liquid used in the wet process is facilitated.

12. A machine as defined in claim 10, wherein said powder diamond coating is a coating applied to said working surface of said at least one roller by electrodeposition.

* * * * *